US005323172A

United States Patent [19]

Koden

[11] Patent Number: 5,323,172

[45] Date of Patent: Jun. 21, 1994

[54] FERROELECTRIC LIQUID CRYSTAL DISPLAY DEVICE

[75] Inventor: Mitsuhiro Koden, Nara, Japan

[73] Assignee: Sharp Kabushiki Kaisha, Osaka, Japan

[21] Appl. No.: 932,343

[22] Filed: Aug. 19, 1992

[30] Foreign Application Priority Data

Aug. 20, 1991 [JP] Japan ..... 3-208088

[51] Int. Cl.[5] ..... G09G 3/36

[52] U.S. Cl. ..... 345/97; 345/95

[58] Field of Search ..... 340/784, 805, 814, 765; 359/55, 56, 57, 59, 76; 345/97, 95, 94, 96, 87, 99

[56] References Cited

U.S. PATENT DOCUMENTS 4,655,550 4/1987 Crossland et al. ..... 359/56

4,909,607 3/1990 Ross ..... 340/784

*Primary Examiner*—Alvin E. Oberley

*Assistant Examiner*—Xiao M. Wu

*Attorney, Agent, or Firm*—David G. Conlin; George W. Neuner

[57] ABSTRACT

A ferroelectric liquid crystal display device comprising a substrate of a plurality of scanning electrodes and a plurality of signal electrodes in the form of a matrix, a switching device formed at each intersecting point of the electrodes, a liquid crystal cell injected with a ferroelectric liquid crystal and a drive controlling means which can apply a signal having a polarity opposite to that of the signal corresponding to a required display from the signal electrode in synchronization with that the signal is applied from the scanning electrode to turn the switching device ON; apply a signal corresponding to the required display from the signal electrode in synchronization with that the signal is applied again from the scanning electrode after a predetermined period of time to turn the switching device ON; and apply a signal from the signal electrode so that the voltage applied to the liquid crystal may be zero in synchronization with that the signal is applied again from the scanning electrode after a predetermined period of time to turn the switching device ON.

3 Claims, 11 Drawing Sheets

⊙⊕ SHOW DIRECTIONS OF SPONTANEOUS POLARIZATION
(⊙ FROM FRONT TO BACK IN DIRECTION PERPENDICULAR TO SURFACE OF SHEET)
(⊕ FROM BACK TO FRONT IN DIRECTION PERPENDICULAR TO SURFACE OF SHEET)

Ẑ: NORMAL LINE OF LAYER

A: DIRECTION OF LONGITUDINAL AXIS OF LIQUID CRYSTAL MOLECULE

θ: TILT ANGLE (PRIOR ART)

(PRIOR ART)

FERROELECTRIC LIQUID CRYSTAL DISPLAY DEVICE

BACKGROUND OF THE INVENTION

1. Field of the Invention

The present invention relates to a ferroelectric liquid crystal display device and more particularly, to a liquid crystal display device combining a switching device and a ferroelectric liquid crystal.

2. Description of the Relates Art

A liquid crystal display device is largely used in a watch, an electronic calculator, a word processor, a personal computer, a pocket television or the like. Recently, a display device of high quality which is capable of large-amount displaying has been especially demanded. As such a display device of high quality, a liquid crystal display device is generally known, which is formed by combining an active matrix substrate on which a thin film transistor (TFT) is arranged in the form of matrix with a twisted nematic (TN) liquid crystal.

However, a serious defect of the liquid crystal display device is that its visual angle is narrow. This problem is peculiar to the TN display. Therefore, as long as this display method is used, the defect can not be really improved. In addition, there is a strong demand for decreasing a driving voltage in respect of economical aspect.

Meanwhile, a visual angle is wide in a ferroelectric liquid crystal. Since the ferroelectric liquid crystal does not have a clear threshold value, if a pulse width for switching is increased, the driving voltage can be decreased theoretically. However, there is the following defect in the normal ferroelectric liquid crystal display device, high contrast is not likely to be obtained because of molecular fluctuation due to a bias voltage.

Thus, it is proposed that the ferroelectric liquid crystal is combined with the active matrix substrate in order to implement a liquid crystal display device in which the visual angle is wide, the driving voltage is low, and the contrast is high.

The ferroelectric liquid crystal display device (Appl. Phys. Lett., 36, 899 (1980); Japanese Opened Patent No. 107216/1981; U.S. Pat. No. 4,367,924) uses a ferroelectric liquid crystal such as a chiral smectic C phase, a chiral smectic F phase or a chiral smectic I phase. Although the ferroelectric liquid crystal has a herical structure, it is found that the helical structure is broken if the ferroelectric liquid crystal is sandwiched between liquid crystal cells having a cell thickness thinner than its herical pitch. Actually, as shown in FIG. 1, it is found that a region where a liquid crystal molecule is inclined from a normal line of a smectic layer by an angle of $\theta$ to be stable and a region where it is inclined in the opposite direction by an angle of $\theta$ to be stable can exist together. When an electric field is applied in the direction perpendicular to the surface of FIG. 1, the directions of the liquid crystal molecule and its spontaneous polarization can be uniformly arranged. Therefore, two states can be switched by changing the polarity of the electric field to be applied. Since bireferegent light is changed in the ferroelectric liquid crystal in the cell through the switching operation, transmitted light can be controlled by putting the ferroelectric liquid crystal display device between two polarizers. In addition, even if application of the voltage stops, since the orientation of the liquid crystal molecule is maintained at a state before the voltage is applied by orientation controlling force of an interface, a memory effect can be also obtained. In addition, in regard to a time required for driving the switching operation, a high-speed response of an order of $\mu$sec can be obtained since the spontaneous polarization of the liquid crystal and the electric field directly act thereon.

FIG. 2 shows the relation between an applied voltage waveform in the ferroelectric liquid crystal display device in which the direction of the polarization axis of polarizing plates crossing at right angles with each other coincides with the direction of longitudinal axis of the molecule at one state of bistable states of the ferroelectric liquid crystal display device, and an amount of the transmitted light. Since the ferroelectric liquid crystal display device has a memory characteristic, preferable switching between two values can be implemented by applying a short pulse and maintaining an electroless state thereafter.

Next, the active matrix substrate will be described. FIG. 3 shows an equivalent circuit of an active matrix type liquid crystal display device using a thin film transistor (TFT) which is a typical 3-terminal type device.

Referring to FIG. 3, reference character G designates a gate electrode, reference character S designates a source electrode, reference character D designates a drain electrode, reference character $V_{com}$ designates a common electrode, and reference character LC designates a liquid crystal capacity. When the liquid crystal is driven, an electric field is applied to the gate electrode by applying a signal from a scanning line and then the TFT turns ON. In synchronization with this, when a signal is applied to the source electrode from a signal line, an electric charge is stored in the liquid crystal capacity through the drain electrode. Thus, the liquid crystal responds by the thus generated electric field.

In a case where the ferroelectric liquid crystal is employed to the active matrix type liquid crystal display, driving waveforms shown in FIGS. 4 and 5 are used.

However, according to the driving method shown in FIG. 4, for example, when display at a certain pixel is not changed for a long period of time, a voltage of the same polarity is applied to the ferroelectric liquid crystal of that pixel. This is a considerably big problem in view of reliability and it is almost impossible to manufacture a practical display device.

Meanwhile, according to the driving method shown in FIG. 5, the voltage applied to each pixel is not partial to minus nor plus, so that the method is thought preferable in view of reliability. However, the following problem is generated in view of a practical display device. That is, a pulse width required for switching the typical ferroelectric liquid crystal is approximately 100 $\mu$sec at a room temperature when the voltage is 10V. Although a more high-speed ferroelectric liquid crystal has been reported, generally it is necessary to increase the spontaneous polarization of the ferroelectric liquid crystal in order to increase the switching speed of the display formed of a liquid crystal material. However, as the spontaneous polarization is increased, it is difficult to obtain preferable bistable switching operation. Since the driving voltage of the liquid crystal display device driven by the TFT is approximately 5V, when it is assumed that the driving voltage is 5V and the pulse width necessary for the switching is 200 $\mu$sec, in the driving waveforms shown in FIG. 5, a writing time per scanning line is 600 μsec. When the liquid crystal display device having 1000 scanning lines is implemented, a time required for rewriting one screen is 600 μsec. If the driving voltage is decreased, that time is further increased. This is long as for the rewriting time. Therefore, this problem has to be improved in order to implement a large-capacity active matrix type ferroelectric liquid crystal display device of high quality.

SUMMARY OF THE INVENTION

The present invention provides a ferroelectric liquid crystal display device comprising a substrate of a plurality of scanning electrodes and a plurality of signal electrodes in the form of a matrix, a switching device formed at each intersecting point of the electrodes , a liquid crystal cell injected with a ferroelectric liquid crystal and a drive controlling means ; wherein said drive controlling means can apply a signal are controlled by applying a signal having a polarity opposite to that of the signal corresponding to a required display from the signal electrode in synchronization with that the signal is applied from the scanning electrode to turn the switching device ON; apply a signal corresponding to the required display from the signal electrode in synchronization with that the signal is applied again from the scanning electrode after a predetermined period of time to turn the switching device ON; and apply a signal from the signal electrode so that the voltage applied to the liquid crystal may be zero in synchronization with that the signal is applied again from the scanning electrode after a predetermined period of time to turn the switching device ON.

DETAILED DESCRIPTION OF THE PREFERRED EMBODIMENTS

The present invention provides an active matrix type ferroelectric liquid crystal display device in which a capacity is large, a visual angle is large, a driving voltage is low, and a high contrast can be driven.

Figure 6:
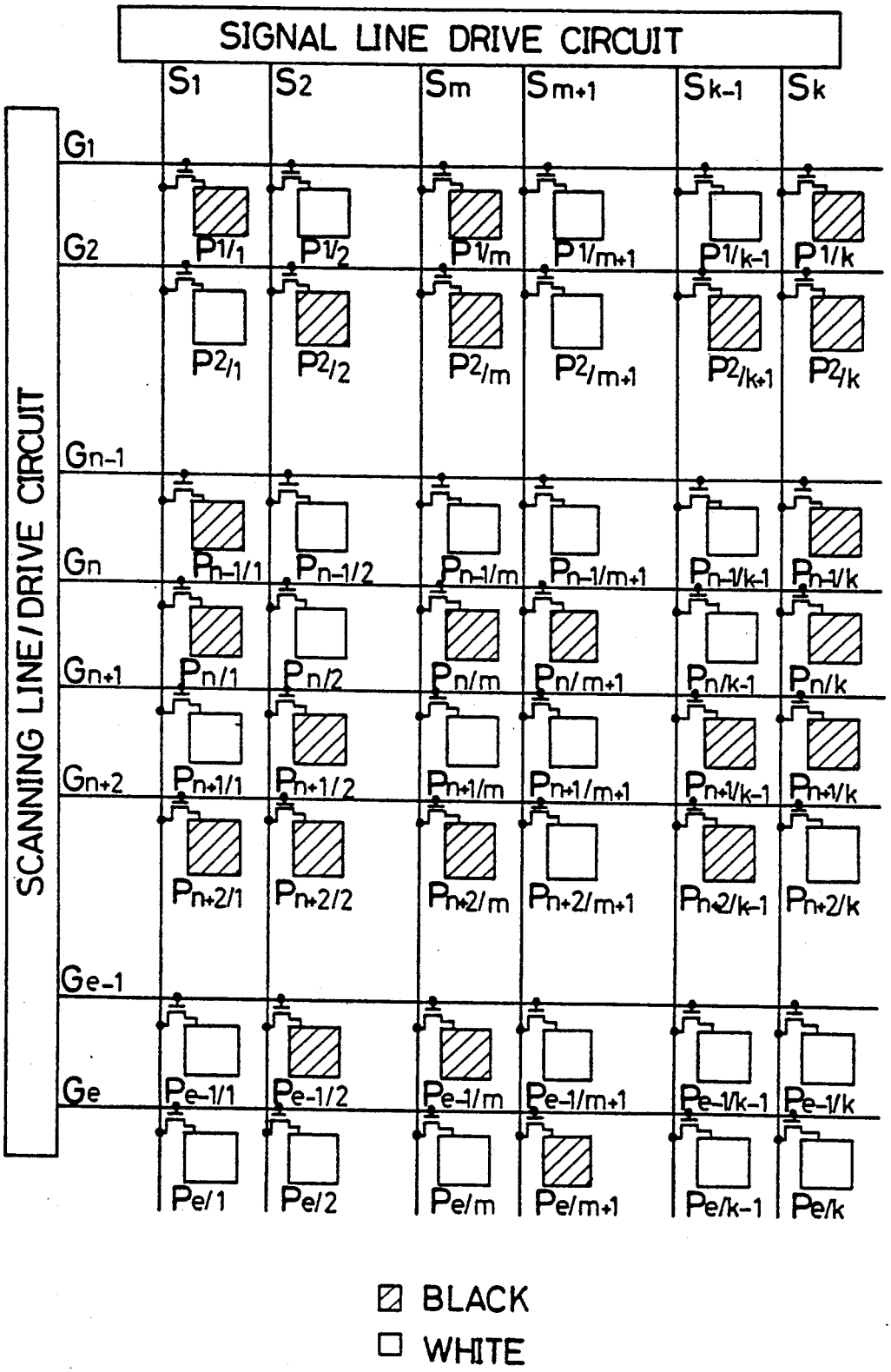
FIG. 6 is a schematic view showing a display of an active matrix type ferroelectric liquid crystal display device of the present invention.
Figure 7:
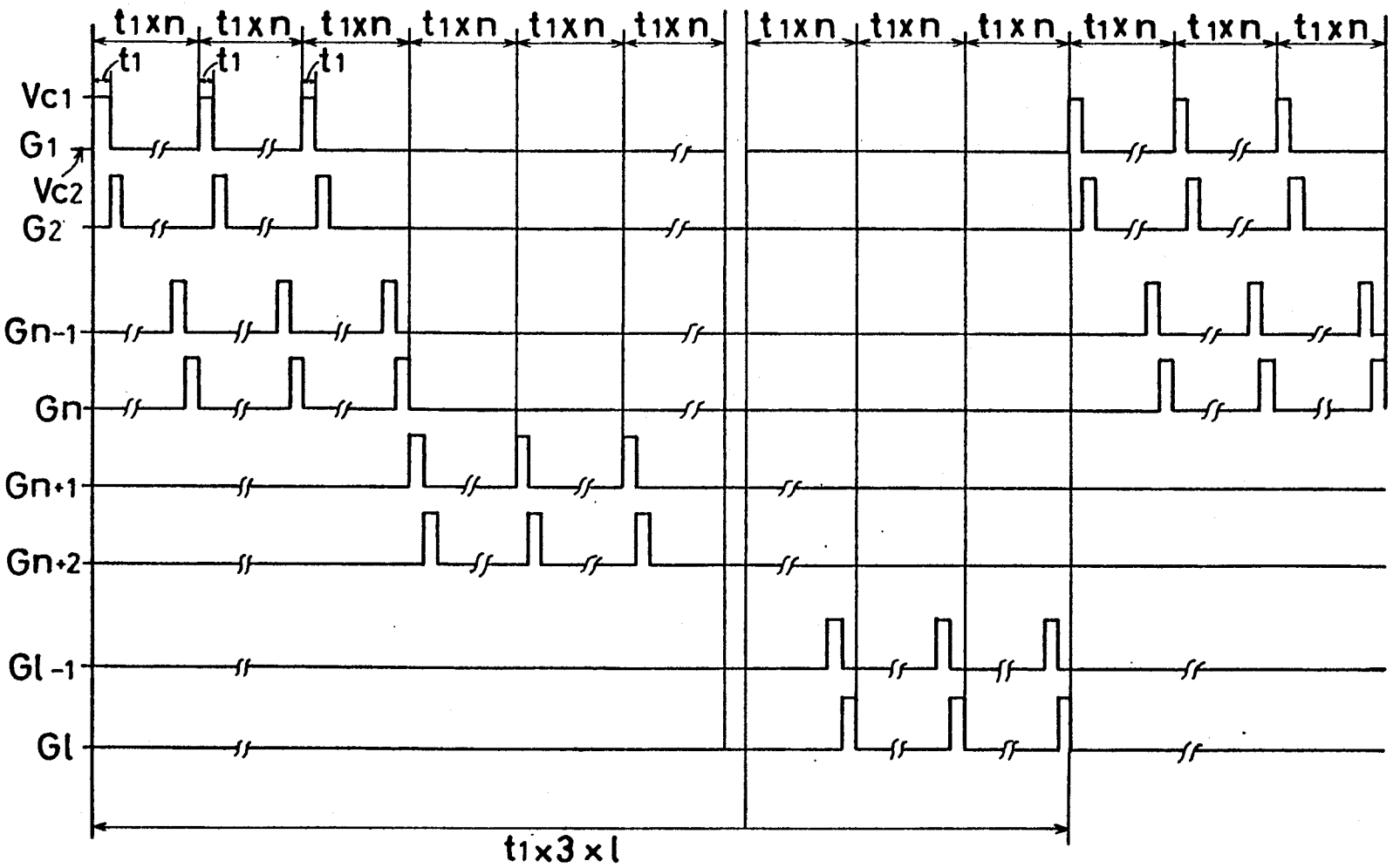
FIG. 7 is a view showing a driving method of the present invention.
Figure 8:
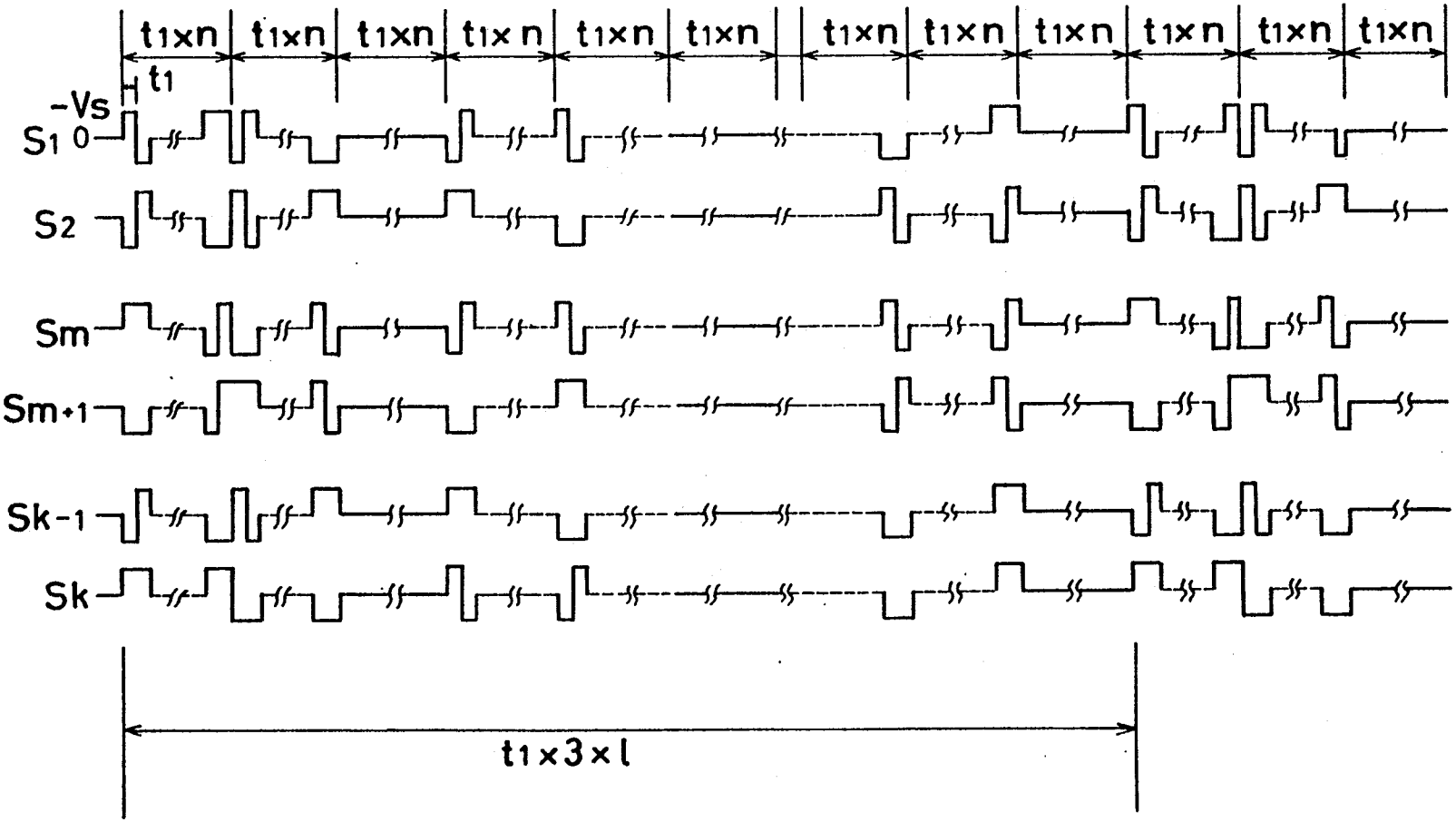
FIG. 8 is a view also showing a driving method of the present invention.
Figure 9:
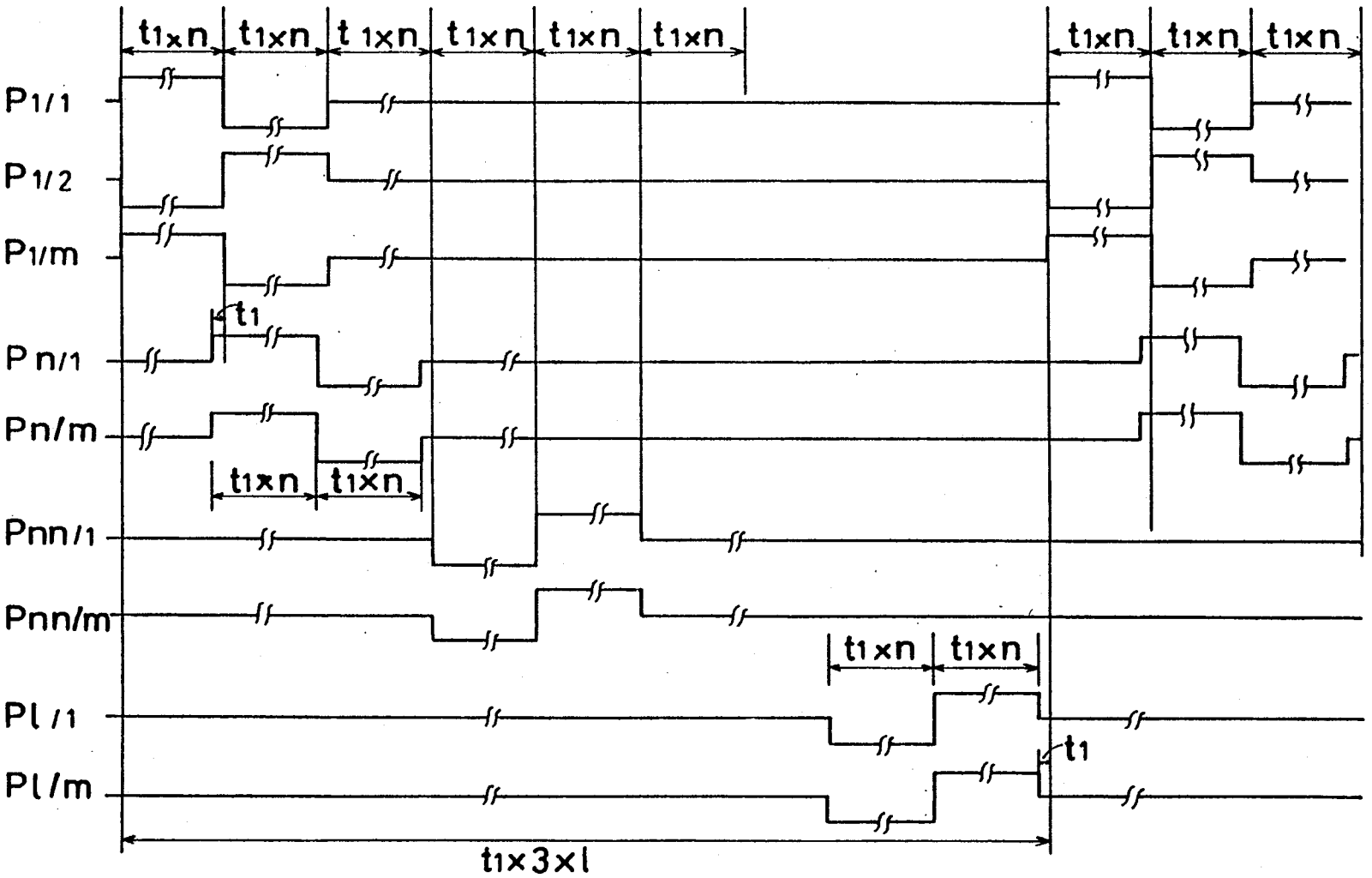
FIG. 9 is a view showing a voltage waveform applied to each pixel in the active matrix type ferroelectric liquid crystal display device of the present invention.

Drive control of the ferroelectric liquid crystal display device of the present invention will be described using a liquid crystal display device in which a ferroelectric liquid crystal is combined with an active matrix substrate on which 1 scanning electrodes $G_1$, $G_2$, . . . $G_{n-1}$, $G_n$, $G_{n+1}$, $G_{n+2}$, . . . , $G_{n-1}$ and $G_1$ and k signal electrodes $S_1$, $S_2$, . . . , $S_m$, $S_{m+1}$, . . . , $S_{k-1}$ and $S_k$ are arranged in the form of a matrix and arranged the TFT at a point of intersection thereof. A gate electrode of the TFT at each intersecting point is connected to a scanning electrode and a source electrode thereof is connected to a signal electrode. $P_{1/1}$, $P_{1/2}$, . . . , $P_{1/m}$, $P_{1/m+1}$, . . . , $P_{n/1}$, $P_{n/2}$, . . . , $P_{n/m}$, $P_{n/m+1}$, . . . designate pixels each connected to the drain electrode of the TFT formed at each intersecting point. When pixels are displayed as shown in FIG. 6, signal waveforms shown in FIGS. 7 and 8 are sent to each scanning electrode and a signal electrode. At this time, voltage waveforms applied to the pixels are as shown in FIG. 9. Polarizing plates are arranged so that white may be displayed when a plus voltage is applied to the ferroelectric liquid crystal and black may be displayed when a minus voltage is applied thereto.

First, a signal is applied from the scanning electrode $G_1$ for a time of $t_1$ to turn the TFT ON. In synchronization with this, a negative voltage $-V_0$ is applied from the signal electrode connected to the pixels $P_{1/2}$, $P_{1/m+1}$ and P1/k−1 which are displayed as white among pixels connected to $G_1$. Contrarily, a positive voltage $V_0$ is applied from the signal electrodes connected to the pixels $P_{1/1}$, $P_{1/m}$ and $P_{1/k}$ which are displayed as black among the pixels connected to $G_1$. Then, for the next time of $t_1$, a signal is applied from $G_2$ to turn TFT ON and in synchronization with this, a signal is applied from the signal electrode. Thus, the TFT's connected to the scanning electrodes $G_1$ to $G_n$ are sequentially turned ON in the same manner as described above.

After the signal is applied from the n'th scanning electrode, a signal is applied from the scanning electrode $G_1$ again for the time of $t_1$ to turn the TFT ON. In synchronization with this, the positive voltage $V_0$ is applied from the signal electrodes connected to the pixels $P_{1/2}$, $P_{1/m+1}$ and P1/k−1 which are displayed as white among pixels connected to $G_1$. Contrarily, the negative voltage $-V_0$ is applied from the signal electrodes connected to the pixels $P_{1/1}$, $P_{1/m}$ and $P_{1/k}$ which are displayed as black among the pixels connected to $G_1$. Then, for the next time of $t_1$, a signal is applied from the $G_2$ to turn the TFT ON and in synchronization with this, a signal is applied from the signal electrode. Thus, the TFT's connected to the scanning electrodes $G_1$ to $G_n$ are sequentially turned on in the same manner as described above.

After the signal is applied from the n'th scanning electrode again, a signal is applied from the scanning electrode $G_1$ again for the time of $t_1$ to turn the TFT ON. In synchronization with this, a voltage of 0V is applied from the signal electrode. In the same manner, the TFT's connected to the scanning electrodes $G_1$ to $G_n$ are sequentially turned ON and in synchronization with this, then a voltage of 0V is applied from the signal electrode.

Then, the same scanning is performed by the scanning electrodes of $G_{n+1}$ to $G_{n+n}$ and then also to $G_1$ in the same manner.

As described above, the switching device is turned on three times to write the display contents one time, which is a specific character of the driving method of the present invention. At this time, the waveform applied to each pixel is not partial to plus nor minus as shown in FIG. 9, which is preferable in respect of reliability.

Although a value of $V_s$ varies with specification of an LSI for driving the liquid crystal display device, for example, 5V may be used. The time $t_1$ is a time required for giving a charge of electricity necessary for obtaining a voltage of $V_s$ by the TFT to electrodes sandwiched by the liquid crystal, which may be 25 μsec, for example. Since the pulse width applied to the liquid crystal is $t_1 \times n$, it is necessary to determine n so that the sufficient time for switching the ferroelectric liquid crystal may be $t_1 \times n$ when the voltage of $V_s$ is applied. For example, if it is assumed that the sufficient time for switching the ferroelectric liquid crystal is 200 μsec and $t_1 = 25$ μsec when the voltage of 5V is applied, n is set at 8. Therefore, in this case, in order to rewrite one screen, a time of $t_1 \times 3 \times 1$ is necessary. In a case a method in which the screen is periodically rewritten is used, $t_1 \times 3 \times 1$ is preferably 16.6 msec or less so that flicker may not be generated. Therefore, when $t_1 = 25$ μsec, the number of 1 is 221 or less. Meanwhile, in a case where a method of partially rewriting is used, even $t_1 \times 3 \times 1$ is 100 msec or more, since a display of high quality can be obtained at sufficiently high speed, the number of 1 can be 1000 or more. When $1 = 1000$ and $t_1 = 25$ μsec, the time for rewriting one screen is 75 msec, which is a sufficiently high-speed display. By using this driving method, even if response speed of the liquid crystal is low, the time required for rewriting one screen is not theoretically increased.

The driving method of the present invention can be applied to a partially rewriting method which applies a signal to only a part where the display contents need to be rewritten in the screen. In this case, a signal is only applied to the scanning electrodes and the signal electrodes connected to the pixels where the display contents need to be rewritten.

In addition, it is possible to adjust a voltage applied to the ferroelectric liquid crystal by applying a voltage to a counter electrode $V_{com}$.

As a switching device provided at each intersecting point of the scanning electrode and the signal electrode, although there are various devices, such as TFT using a-Si or poly-Si, laddic device, plasma address type device, the TFT using a-Si or poly-Si is preferable among them.

Figure 10:
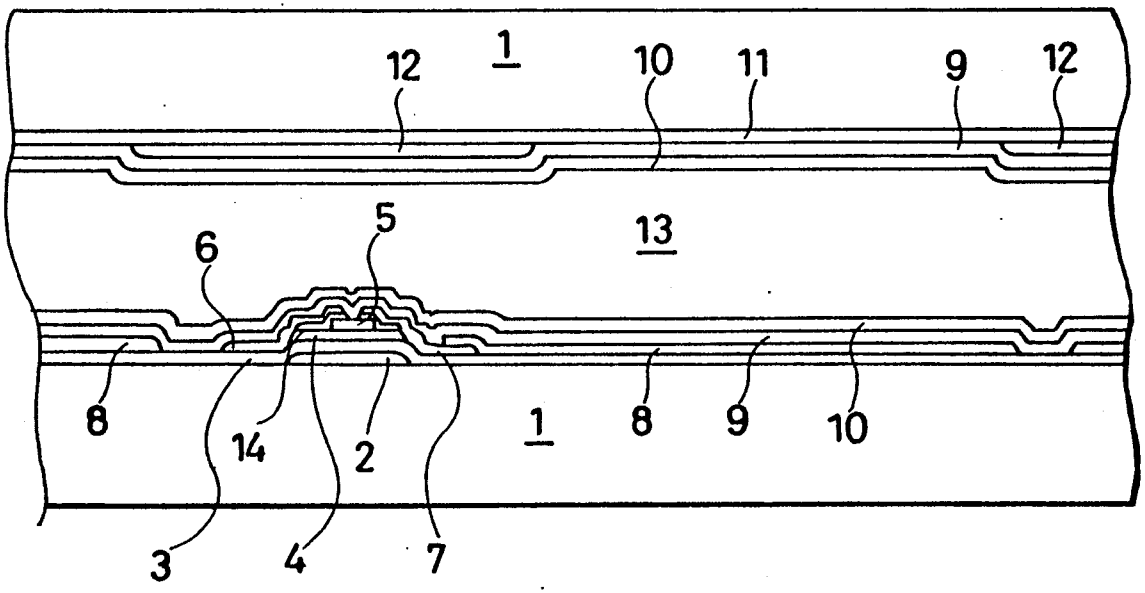
FIG. 10 is a sectional view showing a structure of the active matrix type ferroelectric liquid crystal display device of the present invention.

FIG. 10 is a sectional view showing an example of a liquid crystal display device of the present invention in which an active matrix substrate using a-Si TFT is combined with the ferroelectric liquid crystal. Referring to FIG. 10, reference numeral 1 designates a substrate, reference numeral 2 designates a gate electrode, reference numeral 3 designates a gate insulating film, reference numeral 4 designates an a-Si semiconductor film, reference numeral 14 designates an $n^+$-a-Si film doped with phosphorus, reference numeral 5 designates an insulating film, reference numeral 6 designates a source electrode, reference numeral 7 designates a drain electrode, reference numeral 8 designates a pixel electrode, reference numeral 9 designates an insulating film, reference numeral 10 designates an orientation film, reference numeral 11 designates a common electrode, reference numeral 12 designates an obscure film, and reference numeral 13 designates a ferroelectric liquid crystal. Although the obscure film 12 is not always necessary, it serves as a black matrix which shields light at a part except for the pixel and functions to prevent the ferroelectric liquid crystal from converting when the electric field becomes zero. Uniaxial orientation processing is performed onto at least one of orientation films 10 on the substrates. Although FIG. 9 shows an example of a device for black-and-white display, it is needless to say that color display is possible by forming a color filter on the substrate.

Although as the orientation film 10 and the ferroelectric liquid crystal 13, various kinds can be used other than one already proposed, a material and a device structure capable of implementing high contrast are preferably used in the present invention. Next, as a preferable example, a liquid crystal will be described, in which directions of the uniaxial orientation processing of a pair of substrates are parallel, a liquid crystal phase to be driven is a chiral smectic C phase, the smectic layer structure of the chiral smectic C phase is a chevron structure which is bent like a dogleg, and its orientation is uniform C1 orientation (C1U orientation).

Figure 11:
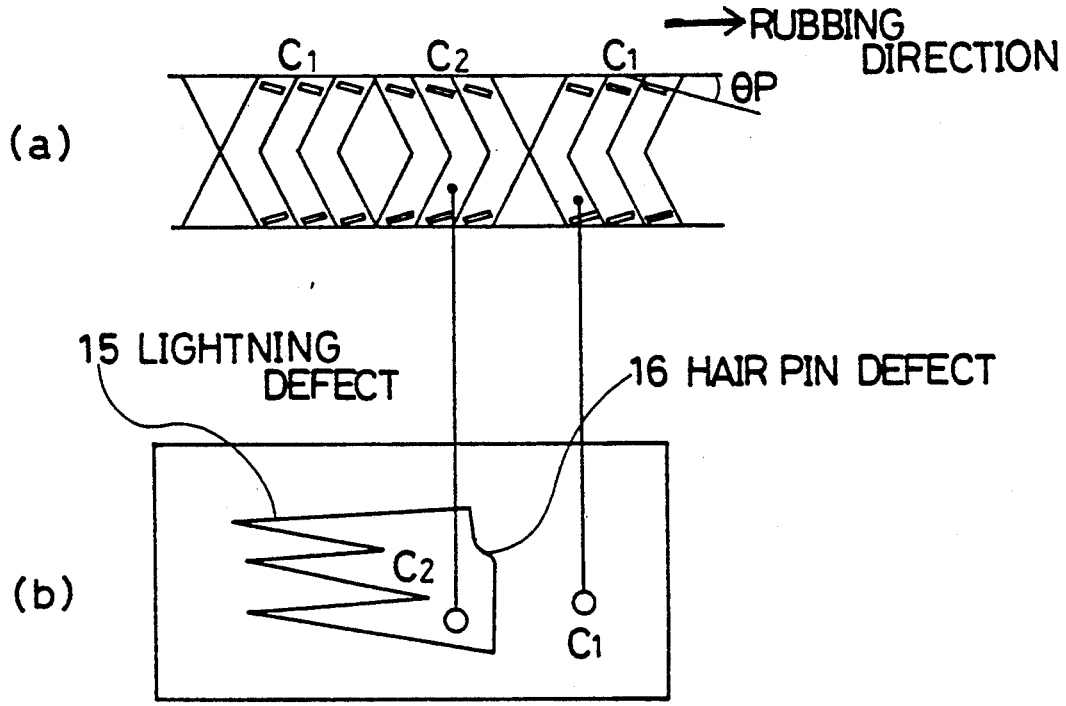
FIG. 11 is a view showing an example of orientation of a ferroelectric liquid crystal.

Generally, the chiral smectic C layer has a doglegged structure, that is, the chevron structure as shown in FIG. 10(*a*). As can be seen from the figure, there are two doglegged directions in the layer. There is generated an orientation defect called a zigzag defect at the doglegged part in the layer. FIG. 10(*b*) shows a schematic view of the zigzag defect observed by a polarization microscope. The zigzag defect is classified into a defect called a lightning defect and a defect called a hair pin defect. It has been found by study that a part of <<>> in the layer corresponds to the lightning defect and a part of >><< in the layer corresponds to the hair pin defect (N. Hiji et al., Jpn. J. Appl. Phys., 27, L1 (1988)). FIG. 11*a* shows the relation between the rubbing direction and the pretilt angle $\theta_p$. The two orientations are called C1 orientation and C2 orientation, in reference to the rubbing direction . A case where the doglegged direction is the same as a rubbing axis defined as C1 orientation (chevron 1) and the opposite case is defined as C2 orientation (chevron 2).

Figure 1:
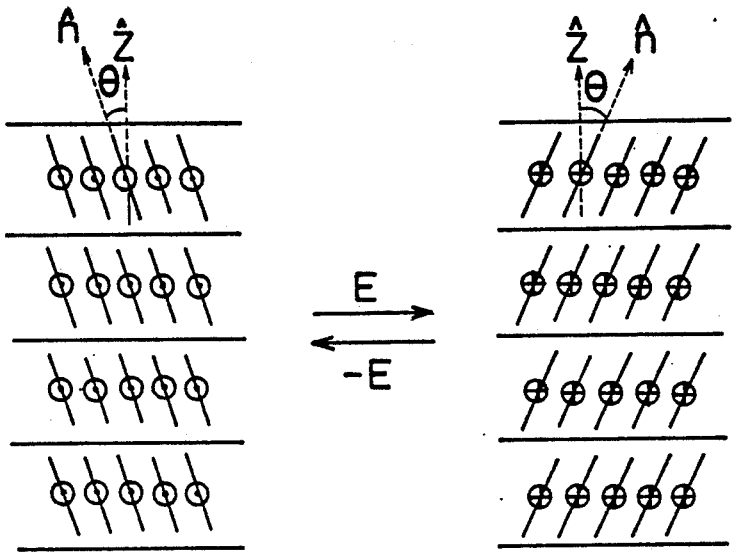
FIG. 1 is a schematic view for describing switching operation of a ferroelectric liquid crystal display device.
Figure 2:
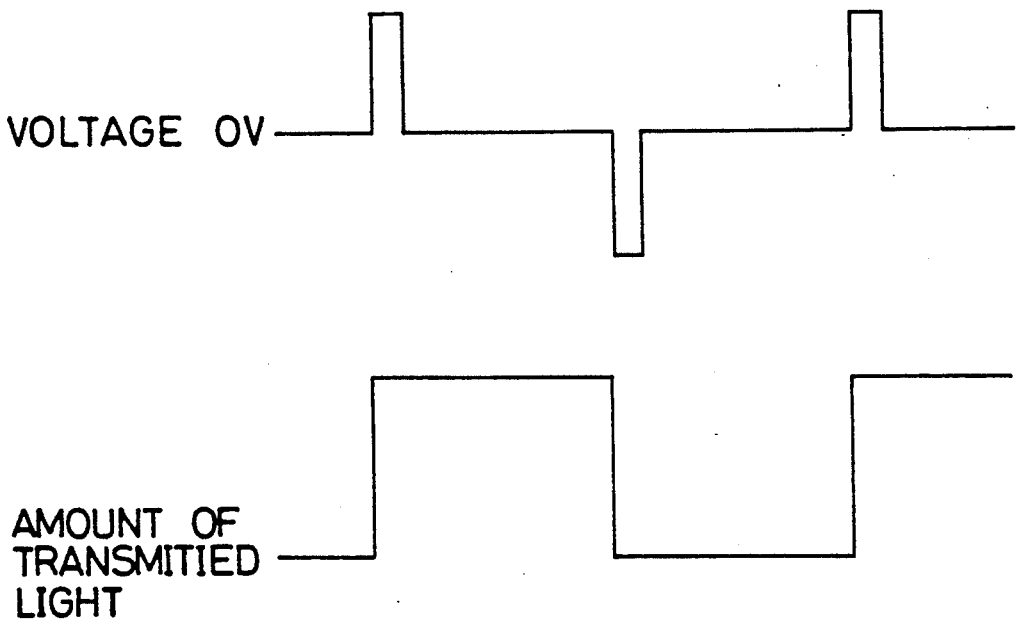
FIG. 2 is a view showing the relation between an applied voltage in the ferroelectric liquid crystal display device and an amount of transmitted light, and their respective changes with the passage of time.
Figure 3:
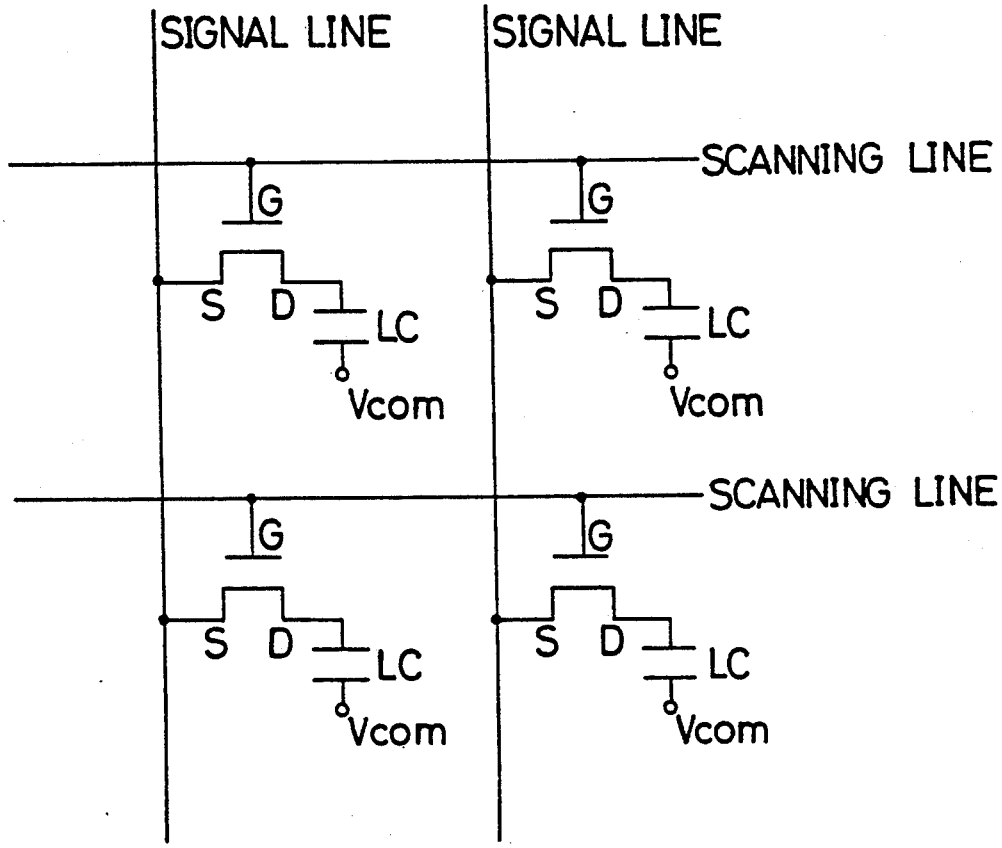
FIG. 3 is a view showing an equivalent circuit of an active matrix type liquid crystal display device.
Figure 4:
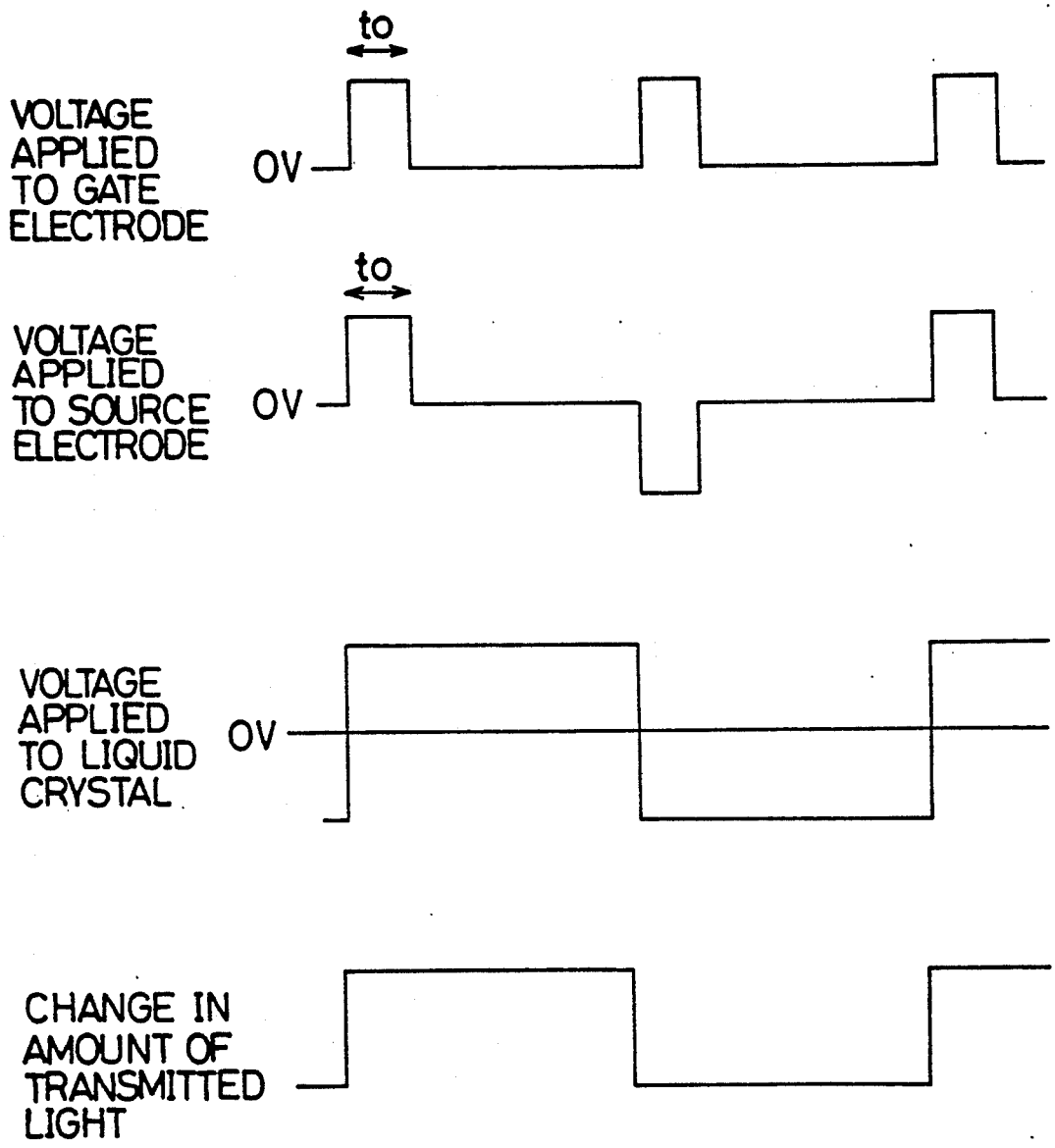
FIG. 4 is a view showing a conventional method of driving the active matrix type ferroelectric liquid crystal display device.
Figure 5:
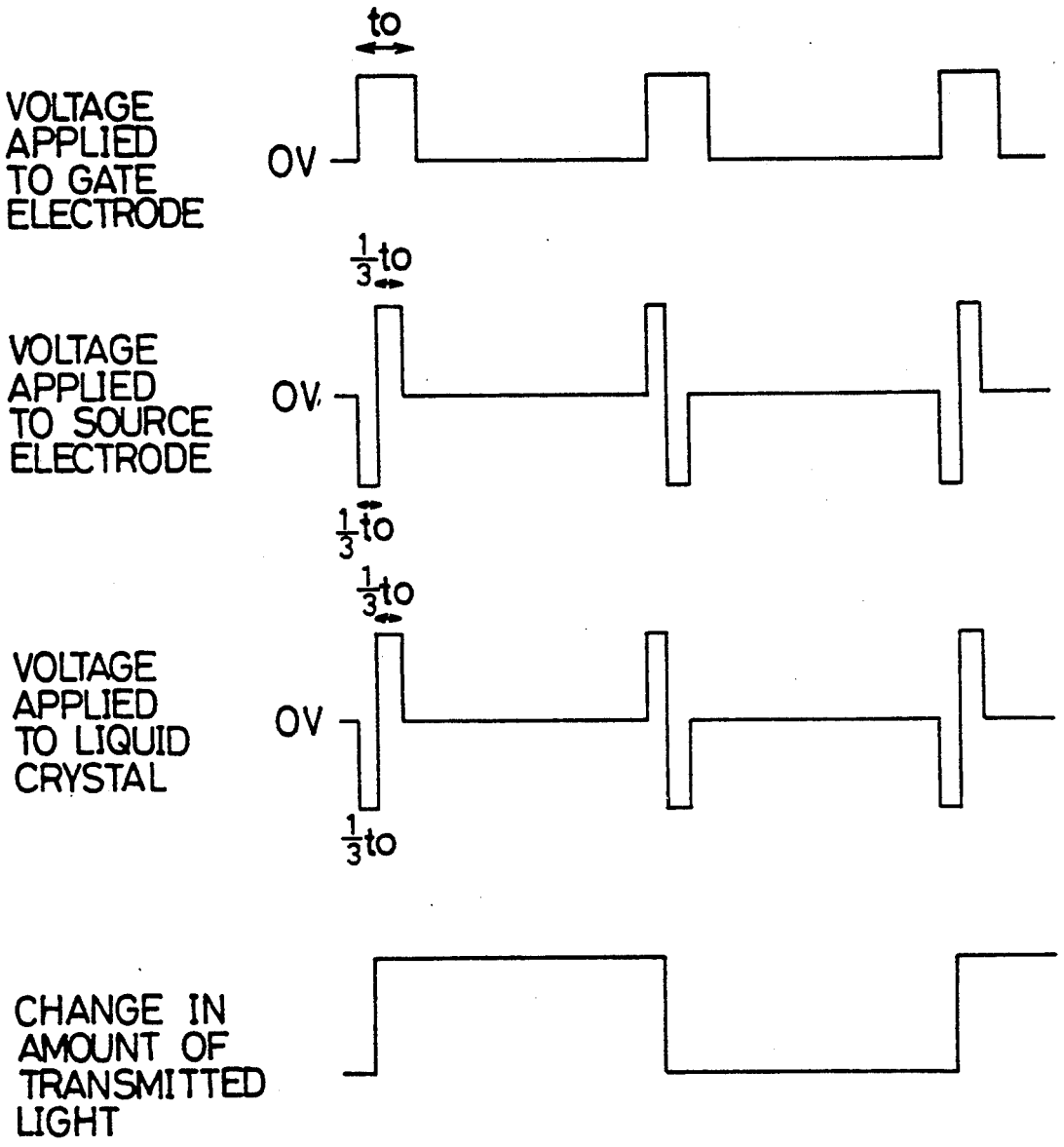
FIG. 5 is a view showing another conventional method of driving the active matrix type ferroelectric liquid crystal display device.

As the pretilt angle $\theta_p$ is increased, the difference between orientation states of the liquid crystal molecules of the C1 orientation and C2 orientation becomes conspicuous. When the orientation film showing a large value of 8° or more (normally 8° to 30°) is used, a region showing a definite quenching and a region not showing the quenching are observed in the C1 orientation on the side of high temperature, and only a region showing the definite quenching is observed in the C2 orientation on the side of low temperature. Since uniform orientation and twist orientation are generally sorted by an existence of the quenching "Structure and Physical Properties of Ferroelectric Liquid Crystal" by Fukuda and Takezoe, Corona Co., Ltd., 1990, pp. 327), it is assumed that the C1 orientation showing the quenching is called C1U (C1 uniform) orientation and the C1 orientation not showing the quenching is called C1T (C1 twist) orientation. Since there is provided only one kind of orientation as for the C2 orientation, it is just defined as the C2 orientation. When the voltage waveform shown in FIG. 2 is applied, while preferable contrast can be obtained in the C1U orientation and the C2 orientation, only low contrast is obtained in the C1T. Since the inventors of the present invention have found that there are the following tendency in the contrast, the C1U orientation is especially preferable in respect of the contrast.

C1U>C2>>C1T

When the pretilt angle $\theta_p$ is not so large, the difference between the contrasts of the C1U orientation and C2 orientation is not so large. The C1U orientation and C2 orientation can be used in the device of the present invention regardless of the value of the angle $\theta_p$.

EXAMPLE

Example 1

Liquid crystal composite materials No. 201 to 203 shown in table 3 were made using compounds No. 101 to 128 shown below. The above liquid crystal composite materials showed the smectic C phase in the room temperature. A phase transition temperature of the composite materials are shown in tables 1 to 2. According to tables 1 to 2, reference character C designates a crystal phase, reference character $S_X$ designates a smectic X phase, reference character $S_C$ designates a smectic C phase, reference character $S_A$ designates a smectic A phase, and reference character I designates an isotropic liquid phase.

No.101

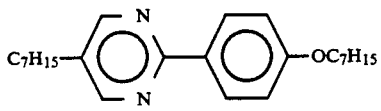

No.102

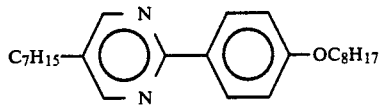

No.103

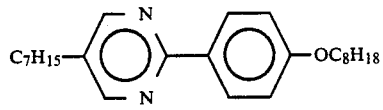

No.104

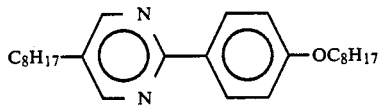

No.105

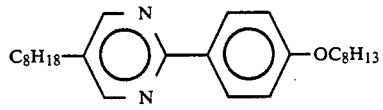

No.106

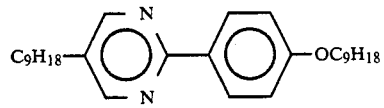

No.107

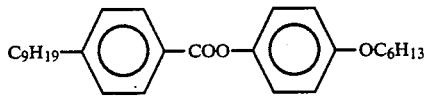

No.108

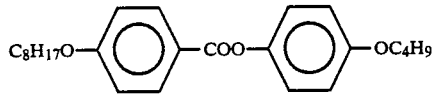

No.109

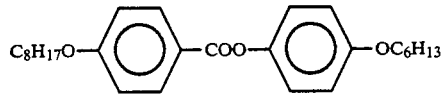

No.110

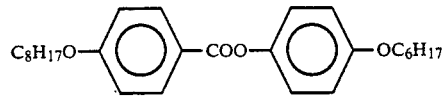

-continued
No.111
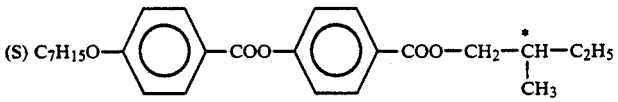
No.112
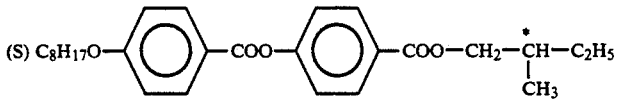
No.113
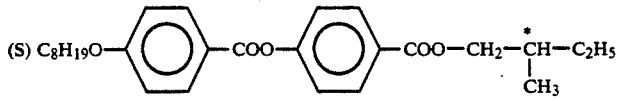
No.114
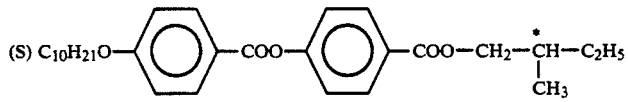
No.115
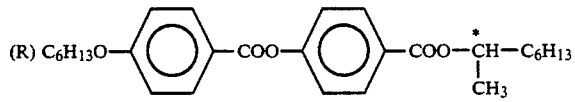
No.116
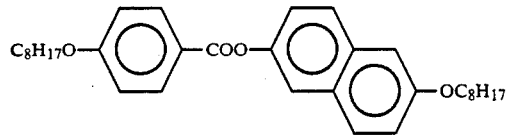
No.117
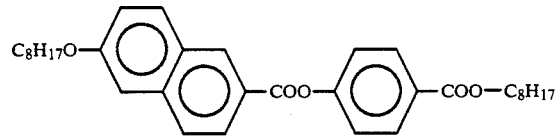
No.118
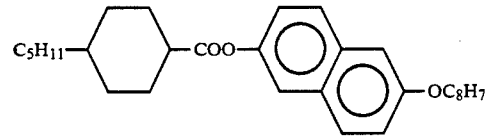
No.119
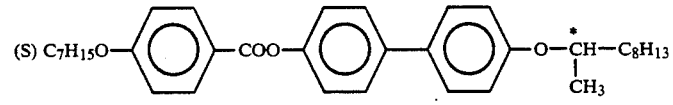
No.120
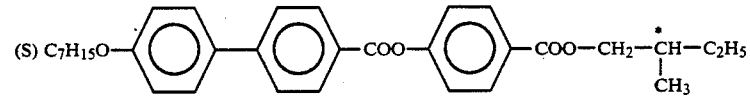
No.121
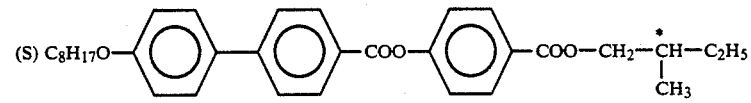
No.122
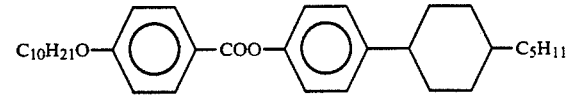

-continued

No.123

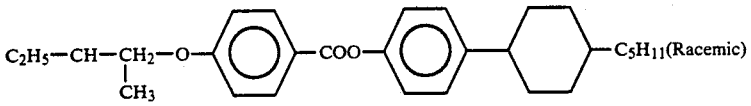

No.124

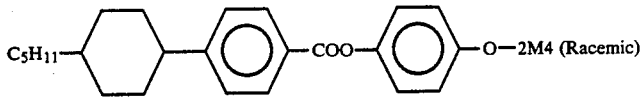

No.125

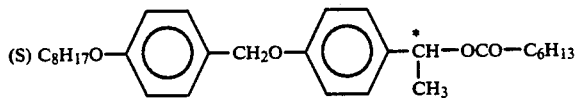

No.126

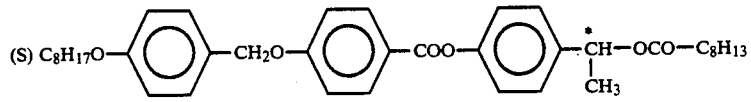

No.127

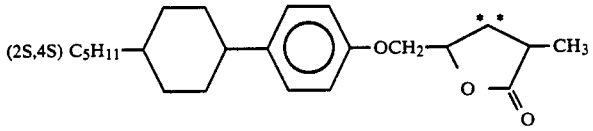

No.128

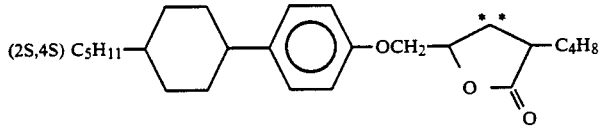

TABLE 1

| Compound | Transition Temp. (°C.) C | Sx | Sc | Sa | N | I |
|---|---|---|---|---|---|---|
| No. 101 | ·38 | — | — | ·47 | ·67 | · |
| 102 | ·49 | — | — | ·44 | ·70 | · |
| 103 | ·46 | — | ·51 | ·57 | ·70 | · |
| 104 | ·29 | — | ·56 | ·62 | ·68 | · |
| 105 | ·24 | — | ·43 | ·70 | ·71 | · |
| 106 | ·35 | — | ·60 | ·75 | — | · |
| 107 | ·41 | — | (·37) | — | ·64 | · |
| 108 | ·58 | — | ·60 | — | ·89 | · |
| 109 | ·55 | — | ·66 | — | ·90 | · |
| 119 | ·61 | — | ·73 | — | ·90 | · |
| 111 | ·35 | — | (·19) | ·53 | — | · |
| 112 | ·33 | — | (·32) | ·58 | — | · |
| 113 | ·56 | — | (·32) | ·57 | — | · |
| 114 | ·52 | — | (·35) | ·60 | — | · |
| 115 | ·48 | — | — | — | — | · |
| 116 | ·70 | — | ·83 | — | ·132 | · |

TABLE 2

| Compound | Transition Temp. (°C.) C | Sx | Sc | Sa | N | I |
|---|---|---|---|---|---|---|
| No. 117 | ·90 | — | — | ·110 | · | · |
| 118 | ·55 | — | (·45) | ·104 | ·116 | · |
| 119 | ·76 | (·54) | ·92 | — | ·125 | · |
| 120 | ·62 | — | ·139 | ·191 | — | · |
| 121 | ·76 | — | ·144 | ·188 | — | · |
| 122 | ·73 | — | ·120 | ·127 | ·170 | · |
| 123 | ·97 | — | — | — | ·164 | · |
| 124 | ·105 | — | — | ·149 | ·164 | · |
| 125 | ·53 | — | — | — | — | · |
| 126 | ·110 | — | — | — | — | · |
| 127 | ·101 | — | — | (·54) | — | · |
| 128 | ·84 | — | — | — | — | · |

An ITO film was formed on two glass substrates, a polyimide orientation film (LX-1400 made by Hitachi Chemical Co., Ltd.) was applied thereon and then it was rubbed. Then, two substrates were put together to have a cell thickness of 2 μm so that the rubbing directions may be the same, and then the ferroelectric liquid crystal composite materials shown in table 3 were injected thereto. Thereafter, the cell was heated once until the liquid crystal composite materials were changed to anisotropic liquid, and then they were cooled down to the room temperature at 1° C./min, whereby the ferroelectric liquid crystal display device having preferable orientation was obtained. The ferroelectric liquid crystal display device was put between polarizing plates crossing at right angles, and then response speed, a tilt angle, a memory angle, and a memory pulse width thereof was measured, which results are shown in table 4. The response speed was obtained from a time when a rectangular wave voltage (V=±10V) is applied at 25° C. until the amounts of transmitted light change from 0 to 50%, from 0 to 90%, and from 10 to 90%. The tilt angle was defined as ½ of an angle formed by two quenching positions obtained when the rectangular wave voltage was applied to the cell. The memory angle was defined as an angle formed by the two quenching positions obtained when the electric field was not applied to the cell. The memory pulse width was defined as the minimum value capable of switching by applying a pulse waveform voltage (V=±10V) at 25° C.

TABLE 3

| Compound | Composite No. 201 | Composite No. 202 | Composite No. 203 |
|---|---|---|---|
| No. 101 | | 10.0 | |
| 102 | | 5.0 | |

TABLE 3-continued

| Compound | Composite No. 201 | Composite No. 202 | Composite No. 203 |
|---|---|---|---|
| 102 | | 16.0 | |
| 104 | | 10.0 | |
| 105 | | 13.0 | |
| 106 | | 44.0 | |
| 107 | | | 24.9 |
| 108 | | | 12.2 |
| 109 | | | 12.5 |
| 110 | | | 11.9 |
| 111 | 9.4 | | |
| 112 | 29.4 | | |
| 113 | 10.6 | | |
| 114 | 9.5 | | |
| 115 | | | 1.4 |
| 116 | | | 4.7 |
| 117 | 4.8 | | 3.4 |
| 118 | | | 4.8 |
| 119 | | | 1.2 |
| 120 | 19.4 | | |
| 121 | 14.9 | | |
| 122 | | | 8.0 |
| 123 | | | 6.4 |
| 124 | | | 6.4 |
| 125 | | | 1.2 |
| 126 | | | 1.0 |
| 127 | | 2.0 | |
| 128 | 2.0 | | |

4, a gate insulating film (SiNx film) 5 were sequentially laminated by plasma CVD in a vacuum and then the insulating film 5 was patterned to be of a predetermined configuration. Then, an $n^+$-a-Si film 14 doped with phosphorus was formed by the plasma CVD and then the $n^+$-a-Si film and the a-Si semiconductor film 4 were patterned. Then, a Ti film was formed by sputtering and the Ti film and the $n^+$-a-Si film 14 were patterned to be of a predetermined configuration, and then 64 source electrodes 6 and drain electrodes 7 were formed. The ITO film was formed by sputtering and then patterned, and a pixel electrode 8 was formed.

The ITO film serving as a common electrode 11 was formed on another substrate by sputtering and then an Mo film serving as an obscure film 12 was formed thereon by sputtering. Then, the Mo film was patterned to be of a predetermined configuration.

The $SiO_2$ insulating films having a thickness of 500 Å were formed on the thus formed two substrates. Then, PSI-X-A-2001 (Polyimide made by Chisso Petrochemical Co., Ltd.) serving as the orientation film was formed by spin coating with a thickness of 400 Å. Then, the uniaxial orientation processing by rubbing was performed using a rayon cloth. Then, these two substrates were put together by a sealing material made of epoxy resin with the space of 2 μm through a silica spacer so

TABLE 4

| | Transition Temp. (°C.) | | | | Response-Speed (μsec) | | | Tilt Angle | Memory Angle | Memory pulse width |
|---|---|---|---|---|---|---|---|---|---|---|
| Comp. | Sc | Sa | N | I | 0→50% | 0→90% | 10→90% | (deg) | (deg) | (μsec) |
| No. 201 | ·40 | ·95 | — | · | 172 | 254 | 154 | 15 | 9 | 180 |
| 202 | ·44 | ·68 | ·70 | · | 111 | 175 | 114 | 11 | 9 | 100 |
| 203 | ·42 | ·75 | ·91 | ·· | 426 | 875 | 650 | 19 | 10 | 350 |

Example 2

An ITO film having a thickness of 1000 A was formed on two glass substrates and then $SiO_2$ insulating film having a thickness of 500 A was formed thereon. Then, the orientation film shown in table 4 was formed thereon with a thickness of 400 A by spin coating and then the uniaxial orientation processing by rubbing was performed using a rayon cloth. Then, the substrates were put together so as to be 20 lm in thickness so that the rubbing directions may be not in parallel, and thus a liquid crystal cell was manufactured. Then, nematic liquid crystal E-8 made by Merrk Co., Ltd. was injected thereto and the pretilt angle formed by the liquid crystal molecule and the substrate was measured by a magnetic field capacity method. The result thereof are shown in table 5.

TABLE 5

| Orientation Film | Pretilt Angle |
|---|---|
| PSI-X-A-2001 (Chisso Petrochemical Co., Ltd.) | 12~15° |
| PSI-X-S-014 (Chisso Petrochemical Co., Ltd.) | 1~2° |
| PVA | 0~5° |

Example 3

The active matrix type ferroelectric liquid crystal display device of the structure shown in FIG. 10 was formed by the following process. First, a Ta film was formed on a substrate made of glass by sputtering and patterned to be of a predetermined configuration, and then 64 gate electrodes 2 were formed. Then, a gate insulating film (SiNx film) 3, an a-Si semiconductor film that those rubbing directions may almost coincide with each other. Then, the ferroelectric liquid crystal composite material No. 201 made in the embodiment 1 was injected from an inlet by a vacuum injection method and then the inlet was cured with an acrylic resin of UV curing type. Thus, a liquid crystal cell was formed. In addition, polarizing plates whose polarizing axes cross almost at right angles were disposed above and below the cell such that one polarizing axis of the polarizing plate may coincide with either one of optical axes of the liquid crystal of the cell, and thus the liquid crystal display device was provided.

It was found that the orientation of the ferroelectric liquid crystal display device was the C1U orientation except a region of the C2 orientation surrounded by a small zigzag defect in a temperature range from a transition point of smectic C-smectic A to the room temperature.

The ferroelectric liquid crystal display device was driven by the driving methods shown in FIGS. 7 and 8. More specifically, it was driven at 25° C. under the condition that $V_{G1}=10V$, $V_{G2}=-15V$, $V_s=5V$, $t_1=25$ μsec, and $n=20$, and then there was provided a preferable display whose rewriting time for one screen was 4.8 msec.

Example 4

An active matrix type ferroelectric liquid crystal display device of a structure shown in FIG. 10 was made in the same manner as in the example 3 except that the liquid crystal composite material No. 201 in the example 3 was changed to the liquid crystal composite material No. 202.

It was found that the orientation of the ferroelectric liquid crystal display device was the C1U orientation except a region of the C2 orientation surrounded by the small zigzag defect in a temperature range from a transition point of smectic C-smectic A to the room temperature.

The ferroelectric liquid crystal display device was driven by the driving methods shown in FIGS. 7 and 8. More specifically, it was driven using various values of n at 25° C. under the condition that $V_{G1}=10V$, $V_{G2}=-15V$, $V_s=5V$ and $t_1=25$ μsec. However, in this case, there was not provided bistable switching. Meanwhile, it could be driven at 33° C. or more, for example, when it was driven at 35° C. under the condition that $V_{G1}=10V$, $V_{G2}=-15V$, $V_s=5V$, $t_1=25$ μsec, and n=5, then there was provided a preferable display whose rewriting time for one screen was 4.8 msec.

Example 5

An active matrix type ferroelectric liquid crystal display device of the structure shown in FIG. 10 was made in the same manner as in the example 3 except that the liquid crystal composite material No. 201 was changed to the liquid crystal composite material No. 202 and the orientation PSI -X-A-2001 (Polyimide made by Chisso Petrochemical Co., Ltd.) was changed to PSI-X-S-014 (polyimide made by Chisso Petrochemical Co., Ltd.).

It was found that the orientation of the ferroelectric liquid crystal display device wa the C2 orientation at the room temperature except a region of the C1 orientation surrounded by a small zigzag defect.

The ferroelectric liquid crystal display device was driven by the driving methods shown in FIGS. 7 and 8. More specifically, it was driven at 25° C. under the condition that $V_{G1}=10V$, $V_{G2}=-15V$, $V_s=5V$, $t_1=25$ μsec, and n=32, and then there was provided a preferable display whose rewriting time for one screen was 4.8 msec.

Example 6

An active matrix type ferroelectric liquid crystal display device of the structure shown in FIG. 10 was made in the same manner as in the example 3 except that the liquid crystal composition material No. 201 in the example 3 was changed to the liquid crystal composite material No. 203.

It was found that the orientation of the ferroelectric liquid crystal display device was the C2 orientation at the room temperature except a region of the C1 orientation surrounded by the small zigzag defect.

The ferroelectric liquid crystal display device was driven by the driving methods shown in FIGS. 7 and 8. More specifically, it was driven at 25° C. under the condition that $V_{G1}=10V$, $V_{G2}=-15V$, $V_s=5V$, $t_1=25$ μsec, and n=32, and then there was provided a preferable display whose rewriting time for one screen was 4.8 msec.

Example 7

An active matrix type ferroelectric liquid crystal display device of the structure shown in FIG. 10 was made in the same manner as in the example 3 except that the liquid crystal composite material No. 201 in the example 3 was changed to the liquid crystal composition material No. 203 and the orientation film PSI-X-A-2001 (polyimide made by Chisso Petrochemical Co., Ltd.) was changed to PVA.

It was found that the orientation of the ferroelectric liquid crystal display device wa the C2 orientation at the room temperature except a region of the C1 orientation surrounded by the small zigzag defect.

The ferroelectric liquid crystal display device was driven by the driving methods shown in FIGS. 7 and 8. More specifically, it was driven at 25° C. under the condition that $V_{G1}=10V$, $V_{G2}=-15V$, $V_s=5V$, $t_1=25$ μsec, and n=40, and then there was provided a preferable display whose rewriting time for one screen was 4.8 msec.

According to the present invention, there can be provided the active matrix type ferroelectric liquid crystal display device of high reliability in which capacity is large, a visual angle is large, and contrast is high.

While, only certain presently preferred embodiments have been described in detail, as will be apparent with those skilled in the art, certain changes and modifications can be made without departing from the scope of the invention as defined by the following claims.

What is claimed is:

1. A ferroelectric liquid crystal display device comprising a substrate having a plurality of scanning electrodes and a plurality of signal electrodes in the form of a matrix, a switching device formed at each intersecting point of the electrodes, a liquid crystal cell injected with a ferroelectric liquid crystal and a drive controlling means;

wherein the display device further comprises means for applying a switching signal for each scanning electrode for a selected time to turn on the switching device;

said drive controlling means further comprising first means for applying a signal having a polarity opposite to that of the signal corresponding to a required display from the signal electrode in synchronization with the switching scanning electrode after a predetermined period of time to turn the switching device ON;

second means for applying a signal corresponding to the required display from the signal electrode in synchronization with the switching signal that is applied again from the scanning electrode after a predetermined period of time to turn the switching device ON; and third means for applying a signal from the signal electrode so that the voltage applied to the liquid crystal may be zero in synchronization with the switching signal that is applied again from the scanning electrode after a predetermined period of time to turn the switching device ON;

whereby the switching device is turned ON three times to write a display contents one time.

2. A liquid crystal display device according to claim 1, wherein said switching device is a thin film transistor.

3. A liquid crystal display device according to claim 1, wherein said ferroelectric liquid crystal forms a liquid crystal layer of a chevron structure showing uniform orientation in which doglegged direction in the chevron structures is the same as a rubbing axis.

* * * * *